US005778506A

United States Patent [19]

Gonzalez

[11] Patent Number: 5,778,506

[45] Date of Patent: Jul. 14, 1998

[54] METHOD FOR BALLISTICALLY ENHANCING A FORMED PANEL

[75] Inventor: René G. Gonzalez, Southfield, Mich.

[73] Assignee: The United States of America as represented by the Secretary of the Army, Washington, D.C.

[21] Appl. No.: 646,759

[22] Filed: Apr. 29, 1996

[51] Int. Cl.[6] ..... B21K 21/16

[52] U.S. Cl. ..... 29/401.1; 29/525.03; 29/525.04; 89/36.02; 296/188

[58] Field of Search ..... 29/525.01, 525.04, 29/525.03, 401.1; 156/212, 213; 89/36.01, 36.02; 102/301, 303; 264/257, 258; 109/49.5; 296/188; 2/2.5

[56] References Cited

U.S. PATENT DOCUMENTS

| | | | |
|---|---|---|---|
| 2,258,238 | 10/1941 | Collins | 156/212 |
| 3,974,313 | 8/1976 | James | 89/36.01 |
| 4,457,985 | 7/1984 | Harpell et al. | 428/911 |
| 5,191,166 | 3/1993 | Smirlock et al. | 89/36.02 |
| 5,333,532 | 8/1994 | Smirlock et al. | 89/36.02 |
| 5,591,993 | 1/1997 | Li et al. | 89/36.02 |
| 5,679,918 | 10/1997 | Korpi et al. | 89/36.02 |

*Primary Examiner*—David P. Bryant
*Attorney, Agent, or Firm*—Peter A. Taucher; David L. Kuhn

[57] ABSTRACT

A method to retrofit a vehicle panel with a ballistic enhancement mat starts by providing a continuous batt of fibrous material. The batt is impregnated with a matrix of material that is, or can be made to be, deformable and then hardened. The batt is cut into mats shaped in an outline of the panel. An individual mat is placed on the panel and conformed to the topography of the panel to create a surface-to-surface interface between the mat and the panel. The mat and panel are fixed together at points all over the interface via an adhesive, a hook-and-loop layer, threaded fasteners or any other suitable mechanical fastening mechanism. The matrix is then hardened, whereby the mat becomes an integral reinforcement mechanism for the panel. The matrix material can be resoftened to facilitate removal of the mat if the mat needs replacement.

17 Claims, 3 Drawing Sheets

METHOD FOR BALLISTICALLY ENHANCING A FORMED PANEL

GOVERNMENT USE

The invention described here may be made, used and licensed by or for the U.S. Government for governmental purposes without paying me royalty.

BACKGROUND AND SUMMARY

One of the pressing problems encountered in modern global peace keeping operations is that mines are encountered in areas travelled by military vehicle having light armor or no armor. The explosive force and shrapnel of the mine detonations penetrate the floors of such vehicle, seriously injuring or killing vehicle occupants. It has been proposed to retrofit such vehicles with mats of cloth-like armor material such as Kevlar™ to reduce damage and injury from shrapnel, which is regarded by some as the more serious problem.

I propose a method to retrofit a vehicle floor panel with a ballistic enhancement mat that not only deters shrapnel but also reinforces the floor panel against the explosive force of a mine blast. My method uses a continuous batt of commercially available batt material. The batt is impregnated by conventional methods with a deformable matrix which is typically made from thermoplastic material. Then the batt is cut into mats shaped in an outline of the vehicle floor panel. Placed on the mat, panel or both is a surface-to-surface bonding agent or attachment mechanism. The mat is laid on the panel and facially conformed to the topography of the panel so that the mat and panel are fixed together all over their interface. The bonding agent or attachment mechanism is such that the topographically conformed mat can later be detached by peeling it from the panel. Once the mat is fixed to the panel, the matrix is hardened by cooling. When the matrix hardens, the mat and floor panel reinforce one another and act as an unitized structural member. If one desires to replace the mat, the mat is resoftened by heating and then peeled from the panel, and thereafter a new mat is installed.

DETAILED DESCRIPTION

Figure 1:
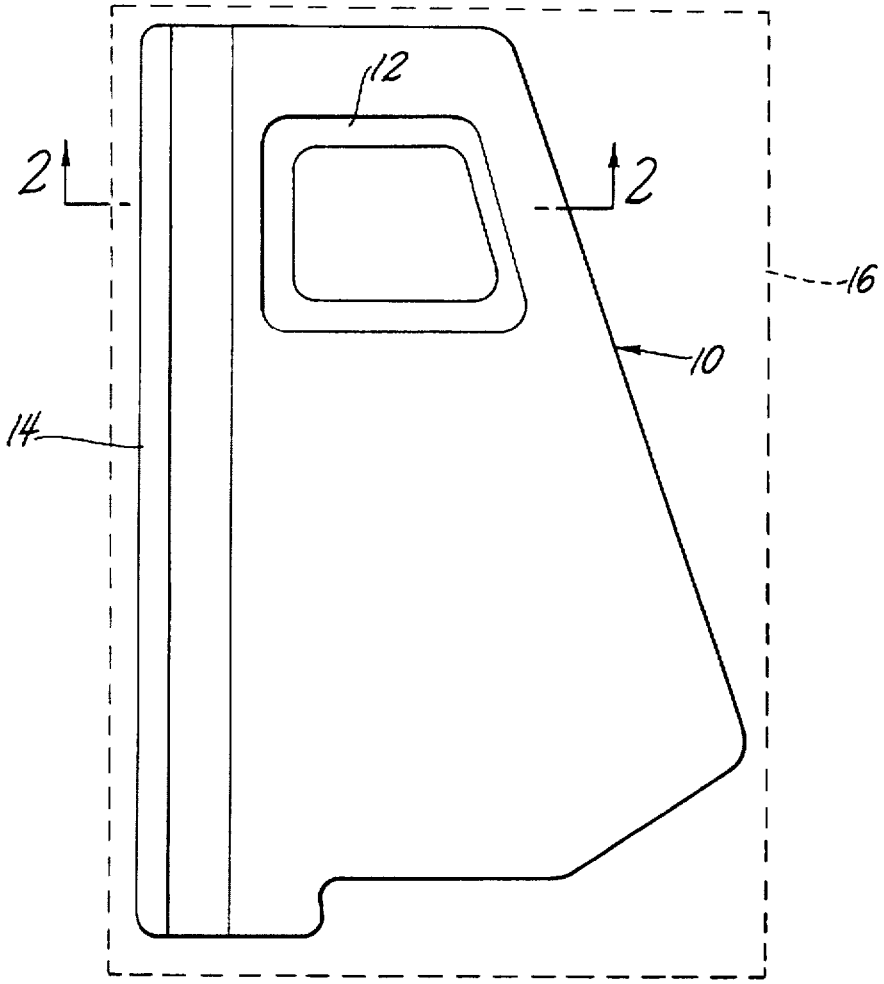
FIG. 1 is a plan view of a typical vehicle floor panel having superimposed thereon a dashed outline of a fibrous batt unit.
Figure 2:
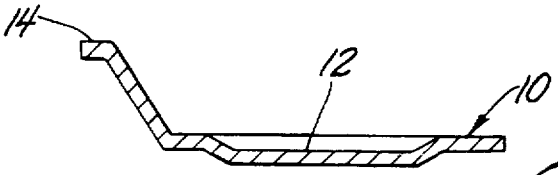
FIG. 2 is section taken from line 2—2 in FIG. 1.
Figure 3:
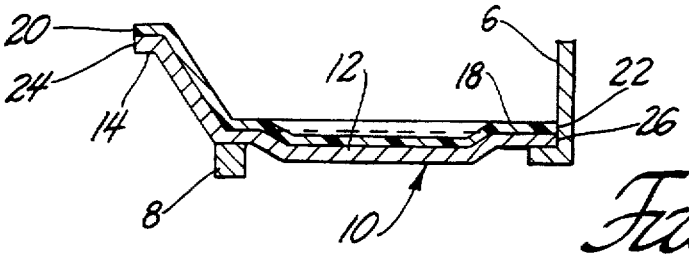
FIG. 3 is a cross section of a vehicle floor panel and adjoining structure, the panel having a mat fit thereon.

In FIG. 1 is a typical metal compartment panel 10 which can be a vehicle floor pan. Panel 10 is welded or otherwise fixed to the body (not shown) or frame member 8 (FIG. 3) or upright panel 6 of a vehicle. Panel 10 can be some other structural panel such as a roof or side wall, or can be an armor panel. Panel 10 is irregular of shape and non-planar in topography, typically having a pan-like recess 12 and a peripheral ridge 14, although panel 10 may have other topographical features such as corrugations, channels or embossed areas. Shown in dashed lines at 16 is the outline of a section of batt 16 from which a liner mat 18 (FIG. 3) is cut for panel 10. Mat 18 is cut so that the mat's peripheral edges will congruently lie along the peripheral edges of panel 10 once mat 18 is fitted thereto. In FIG. 3, for example, mat edges 20 and 22 lie atop corresponding panel edges 24 and 26.

Figure 4:
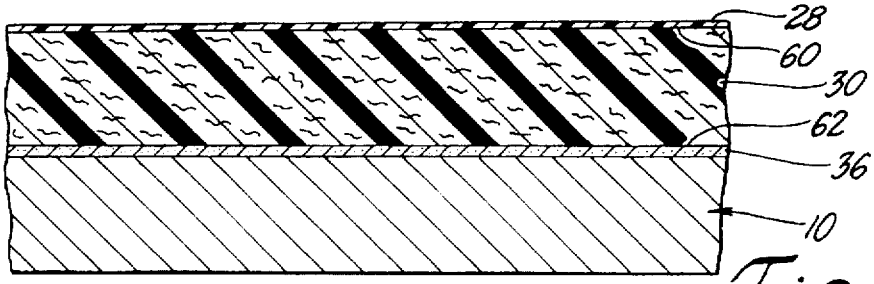
FIGS. 4, 5 and 6 are cross sections of a mat on the floor panel.

FIG. 4 is a detail view of a partial section of mat 18 and underlying panel 10. In that figure, outer surface layer 28 is an optional flexible protective cover for the mat which keeps dirt, oil or other foreign material from harming interior layers of the mat. Interfaced to layer 28 is flexible armor layer 30 having one or any number of sheets comprised of fibers, strands or braided threads of any suitable fibrous material. Such material includes kevlar™ arimid fiber, polymers such as nylon, metal strands, fiberglass or a combination of these materials. The sheets of armor layer 30 act much the same way as layers of a flack jacket to stop bullets or fragments from entering the compartment of which panel 10 is part. The sheets can have a relatively open weave so as to resemble a mesh, or can have a close weave so as to resemble cloth, or else the sheets can have a knitted structure.

Figure 7:
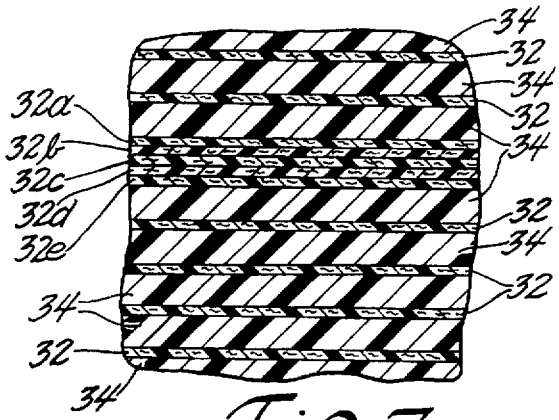
FIGS. 7 and 8 are detail cross sections of optional structures of the mat.

Permeating layer 30 is a thermoplastic matrix material that impregnates the sheets and occupies any interlaminar space between the sheets. Examples of impregnated, layered structure of layer 30 are in the detailed cross section of FIG. 7. The first example comprises fibrous sheets 32 permeated with the thermoplastic material and having substrata 34 between sheets 32. Substrata 34 are comprised of the thermoplastic material, which is integral or continuous with the thermoplastic material permeating sheets 32. The second example (FIG. 7) comprises a series of sheets 32*a*, 32*b*, 32*c*, 32*d* and 32*e* that have no interlaminar space therebetween. These latter sheets are also permeated by a thermoplastic material which is continuous with the thermoplastic material of substrata 34.

The thermoplastic material is relatively rigid at ambient temperatures. However, this material typically becomes plastically deformable at temperatures higher than maximum passenger compartment temperatures for a military vehicle. Preferably the material becomes plastic at no lower than 150° F. or therabouts and need not be heated above the boiling point of water to become plastically deformable. Once the thermoplastic material softens at the higher temperatures, the sheets of layer 30 can slide relative to one another and relative to layer 28. It may be desired that, at ambient temperatures, the thermoplastic material is less malleable and more brittle than panel 10. The relatively higher brittleness of the thermoplastic material causes the propagation of cracks in the material as panel 10 bends or bulges due to an explosive impact. This propagation will in some instances absorb enough energy from an explosion to save panel 10, whereby mat 18 functions as sacrificial armor.

In the case of a relatively high brittleness of the thermoplastic material, it is preferred that at one of the sheets is at the laminar boundaries 60 and 62 (FIG. 4) of the matrix material. It is further preferred that at least some of the strands of fibers comprising the sheets of layer 30 be more ductile or malleable than the thermoplastic material. The relatively higher ductility of the fibers will enable them to survive cracking of the thermoplastic material so that the sheets of layer 30 prevent the thermoplastic material from spalling.

As an alternative, the thermoplastic material can be replaced by material sensitive to deformation rate. That is, the material is a strain rate sensitive material whose stress-to-strain ratio increases as speed of deformation increases or attempts to increase. Thus the material will rigidify when subjected to high, sudden impacts from explosions but will deform slowly when subjected lower forces for longer periods. Both the rate sensitive material and the thermoplastic material of the mat matrix may be deemed reversibly or impermanently hardenable. That is, these materials can re-soften after hardening.

Returning to FIG. 4, there is between mat 18 and panel 10 a stratum 36 by which the mat is fastened to panel 10. Stratum 36 can be simply a layer of adhesive completely covering the area between the mat 18 and panel 10. Stratum 36 can be of the same thermoplastic material as that in layer 30 should that material have adhesive qualities. In such a case, the thermoplastic material of stratum 36 would preferably be integrally continuous with the thermoplastic material of layer 30. Alteratively, stratum 36 can be comprised of one of a well known system of hook-and-loop fasteners such as Velcro™ fasteners.

It is contemplated that mat 18 may sometimes be damaged or destroyed by an explosion but panel 10 will survive. Consequently, it may be preferred that stratum 36 allow subsequent removal of mat 18 by applying a relatively light scraping or peeling force, or by the use of solvents. Thereafter a new mat can be installed.

Screws, bolts or like fasteners can also be used to fix mat 18 to panel 10, but doing so requires forming the necessary holes in panel 10 and installation of the mat may become overly time consuming. In addition, the bolts, screws or other fasteners will become concentration points for force when panel 10 is subjected to an explosion. Therefore, to counteract the effect of an explosion, a great number of such fasteners will be needed all over panel 10 to keep mat 18 and panel 10 together.

Figure 5:
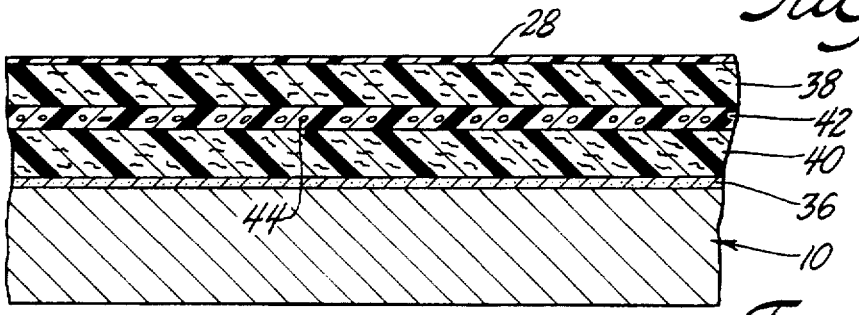

FIG. 5 shows another structure for mat 18 wherein the outer surface layer 28 and adhesive stratum 36 are unchanged but the mat's middle layers are modified. Adjacent outer layer 28 in FIG. 5 is an impregnated fibrous layer 38 similar in structure to layer 30. Adjacent stratum 36 is another impregnated fibrous layer 40 which is also similar in structure to layer 30. Between layers 38 and 40 is a layer 42 comprising a matrix of earlier described thermoplastic or rate sensitive material in which are inclusions exemplified at 44. As before, the matrix of layer 42 is integrally continuous with the matrix material of layers 38 and 40. Inclusions 44 are a means to reinforce the mat against puncture by relatively small projectiles such as bullets, mine fragments or flying debris. Inclusions 44 are therefore harder than the matrix material is during its more rigid state. Typically inclusions 44 are made of ceramic material or hardened steel and are bonded or adhered to the surrounding matrix of layer 42.

Figure 6:
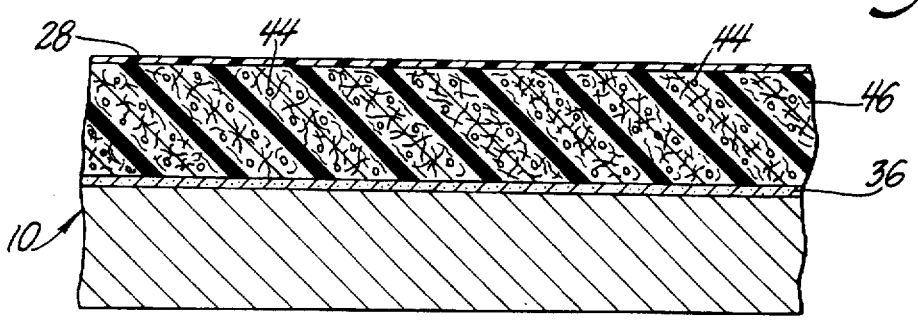

FIG. 6 shows still another structure for mat 18 wherein the outer surface layer 28 and adhesive stratum 36 are unchanged but the mat's middle layer is again modified. In FIG. 6, the middle layer 46 is comprised of a coherent, tomentum-like body of intertangled strands or braided threads. The strands or threads are typically comprised of kevlar™, arimid or like fiber, polymers such as nylon, metal, fiberglass or a mix of these materials. Permeating the tomentum-like body is a matrix of the aforementioned thermoplastic or rate sensitive material having inclusions 44 therein. A layer structured similar to layer 46 may replace either or both of layers 38 and 40 in FIG. 5.

Figure 8:
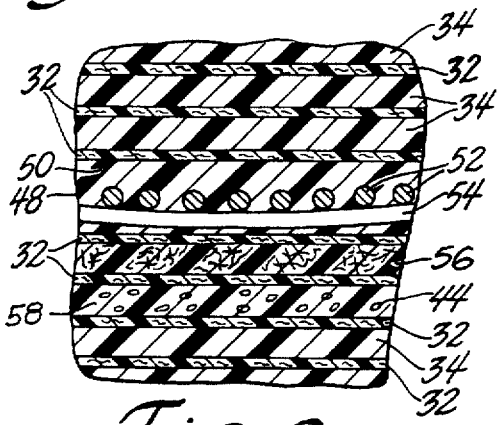

Further potential structures of mat mediate layers and combinations of such layers are shown in FIG. 8. There, layer 48 has a matrix 50 of the thermoplastic or rate sensitive material in which run a set of wire-like elements 52. Transverse to wire-like elements 52 is a second set of wire-like elements 54. Elements 52 and 54 may be resistance heating elements for producing heat within mat 18 or they may simply be heat conduction elements that speed transfer of heat into the mat from an external source.

Another alternative is layer 56, which is similar in structure to layer 46 except that inclusions 44 are absent from layer 56. Layer 58 is similar to layer 46 except that no fibers or strands are in layer 58. Layers 56 or 58 can be used as additional mediate mat layers in the FIG. 5 embodiment; in the alternative, layers 56 or 58 can replace one or more of layers 38, 40 or 42 in FIG. 5.

Figure 9:
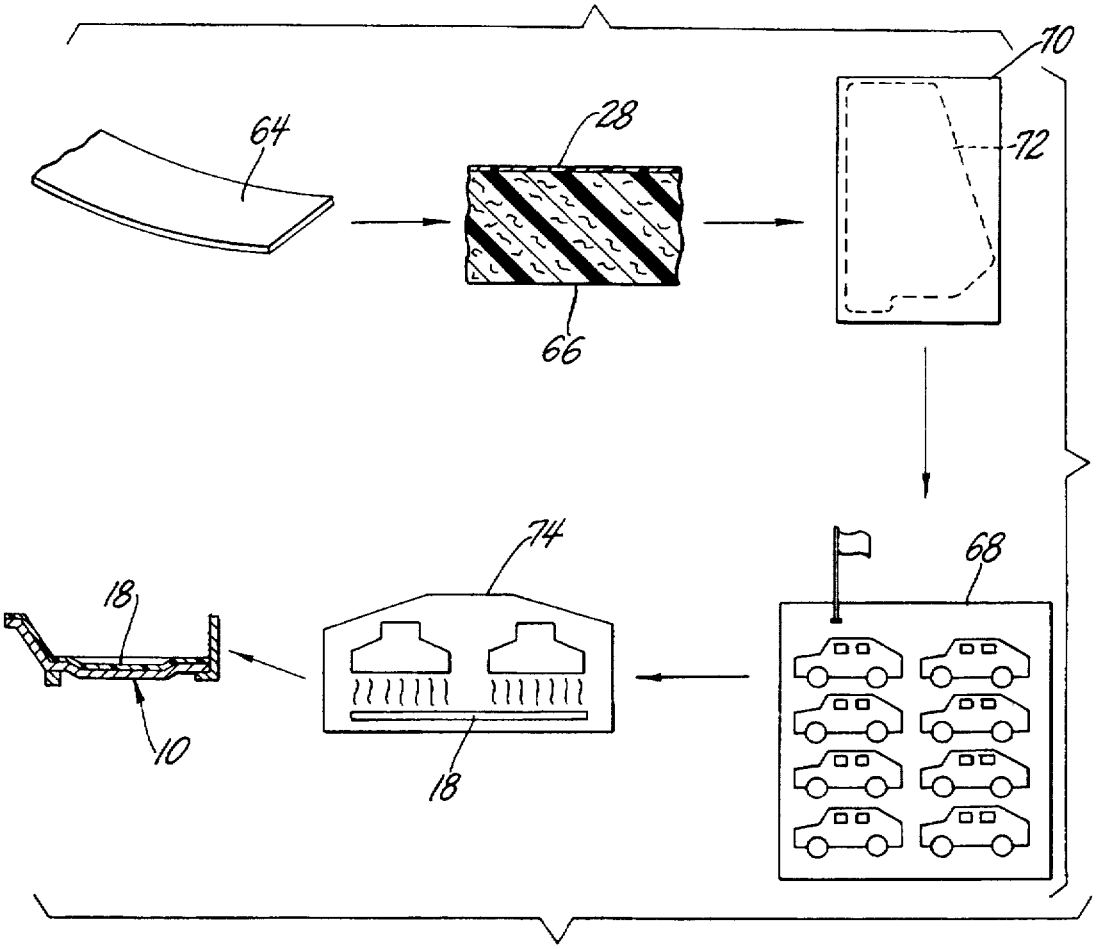
FIG. 9 shows a process of mat fabrication and installation.

FIG. 9 illustrates one process by which mats 18 would be fabricated and installed in existing military vehicles. The first step in this process is simply the conventional manufacture of a continuous batt 64. The fibrous material of batt 64 is configured similarly to the fibrous material of layer 30 in FIG. 4. Batt 64 is impregnated with a thermoplastic matrix material so as to have the cross sectional batt structure shown at 66 and similar to layer 30. Batt structure 66 optionally has outer surface layer 28 placed thereon after impregnation of the fibrous material. The continuous batts are then cut into flat rectangular blanks 70 and thereafter trimmed to an outline 72 of the vehicle compartment panel. Next, the trimmed rectangular blanks, which can be regarded now as mats 18, are shipped to world wide locations such as U S Army depots or marshalling yards, designated by reference numeral 68.

After shipping, mats 18 are heated in oven 74 or by other suitable means to soften the thermoplastic matrix material. After being heated, mat 18 is then laid upon panel 10 and conformed to the topography thereof, both the fibrous material and matrix material deforming to match the shape of panel 10. Then mat 18 is allowed to harden and cool. Prior to the laying of mat 18 on panel 10, adhesive can be applied to the panel or the mat, the adhesive bonding the mat to the panel after the mat cools. As noted before, mechanical devices can be used to fix mat 18 to panel 10, these devices including threaded fasteners, clamps or hook-and-loop fasteners. In the case where the mat's matrix material is strain rate sensitive, the heating of mat 18 is omitted.

I wish it to be understood that I do not desire to be limited to the exact details of construction or method shown herein since obvious modifications will occur to those skilled in the relevant arts without departing from the spirit and scope of the following claims.

What is claimed is:

1. A method of reinforcing a nonplanar panel in a vehicle or other enclosed structure both against explosive blasts and flying debris, comprising:

providing a mat comprised of at least one plastically deformable matrix and fibrous material impregnated by the matrix;

cutting the mat to the outline shape of the panel;

placing the mat on the panel and conforming the mat to the topography of the panel, thereby creating a surface-to-surface interface between the mat and the panel;

removably fixing the mat to the panel at points all over the interface; and after conforming the mat to the topography of the panel, hardening the matrix material.

2. The method of claim 1 wherein the matrix is less malleable than the panel at ambient temperatures.

3. The method of claim 2 wherein at least some of the fibrous material is more ductile than the matrix at ambient temperatures.

4. The method of claim 1 wherein at least some of the fibrous material is more ductile than the matrix at ambient temperatures.

5. The method of claim 1 wherein at least some of the fibrous material is comprised of woven sheets mobile relative to one another before hardening of the matrix.

6. The method of claim 5 wherein at least one of the sheets is at each laminar boundary of the matrix.

7. The method of claim 1 wherein the step of fixing the mat to the panel at points all over the interface is comprised of removably adhering the mat to the panel.

8. The method of claim 7 wherein the step of fixing the mat to the panel at points all over the interface is comprised of using hook-and-loop fasteners to affix the mat to the panel.

9. The method of claim 1 wherein the plastically deformable matrix is a thermoplastic material becoming plastically deformable at temperatures above about 150° F. and the method further comprises:

heating the mat above about 150° F. before placing the mat on the panel;

wherein hardening of the matrix is accomplished by allowing the mat to cool to a temperature below about 150° F.

10. The method of claim 1 wherein:

the plastically deformable matrix is a strain rate sensitive material; and hardening of the matrix occurs when the panel and mat are subjected to deformation by an explosive force.

11. The method of claim 1 wherein the the mat is a first mat and wherein it is desired to replace the first mat, the method further comprising:

resoftening the first mat by heating;

removing the first mat from the panel;

providing a second mat comprised of at least one plastically deformable matrix and fibrous material impregnated by the matrix;

cutting the second mat to the outline shape of the panel;

placing the second mat on the panel and conforming the second mat to the topography of the panel, thereby creating a surface-to-surface interface between the second mat and the panel;

removably fixing the second mat to the panel at points all over the interface; and after conforming the second mat to the topography of the panel, hardening the matrix.

12. A method of reinforcing a nonplanar panel in a vehicle compartment both against explosive blasts and flying debris, comprising:

providing a mat comprised of fibrous armor material;

impregnating the mat with a plastically deformable matrix material;

cutting the mat to an outline of the panel;

placing the mat on the panel and conforming the mat to the topography of the panel, thereby creating a surface-to-surface interface between the mat and the panel;

removably fixing the mat to the panel at points all over the interface; and after placing the mat on the panel, hardening the matrix material after conforming the mat to the topography of the panel.

13. A method of retrofitting mats onto interior nonplanar panels in a vehicle compartment, the mats reinforcing the panels both against explosive blasts and flying debris, comprising:

fabricating a continuous flat batt comprised of flexible fibrous armor material;

impregnating the mat with a single plastically deformable matrix material;

cutting the batt into mats shaped in an outline of corresponding panels;

heating the mats until they become plastically deformable;

placing the mats in the vehicle compartment on the panels and plastically conforming the mats to the topography of the panels, thereby creating a surface-to-surface interface between the mats and the panels;

fixing the mats to the panels at points all over the interface; and allowing the matrix material to cool and harden after conforming the mats to the topography of the panels so that the mats and panels act as integrated structural units.

14. The method of claim 13, wherein the continuous batt comprises a layer of intertangled strands of the fibrous armor material.

15. The method of claim 14 wherein at least some of the strands are braided.

16. The method of claim 13 wherein the matrix material contains inclusions bonded thereto which are harder than the matrix material during a hardened state of the matrix material.

17. The method of claim 13 wherein the the mat is a first mat and wherein it is desired to replace the first mat, the method further comprising:

resoftening the first mat by heating;

removing the first mat from the panel;

providing a second mat comprised of the single plastically deformable matrix material and fibrous material impregnated by the matrix material;

cutting the second mat to the outline shape of the panel;

placing the second mat on the panel and conforming the second mat to the topography of the panel, thereby creating a surface-to-surface interface between the second mat and the panel;

removably fixing the second mat to the panel at points all over the interface; and after conforming the second mat to the topography of the panel, hardening the matrix material.

* * * * *